US007568465B1

(12) United States Patent
Wiley

(10) Patent No.: US 7,568,465 B1
(45) Date of Patent: Aug. 4, 2009

(54) ENGINE RETARDER HAVING MULTIPLE MODES

(75) Inventor: Stephen M. Wiley, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/081,645

(22) Filed: Apr. 18, 2008

(51) Int. Cl.
*F02D 13/04* (2006.01)
*F02D 13/06* (2006.01)

(52) U.S. Cl. ..... 123/321; 123/320

(58) Field of Classification Search ..... 123/321, 123/320, 322, 90.15, 90.11, 90.12
See application file for complete search history.

(56) References Cited

U.S. PATENT DOCUMENTS

| | | | | |
|---|---|---|---|---|
| 4,510,900 | A * | 4/1985 | Quenneville | 123/321 |
| 4,793,307 | A * | 12/1988 | Quenneville et al. | 123/323 |
| 4,925,196 | A | 5/1990 | Green et al. | |
| 4,981,119 | A * | 1/1991 | Neitz et al. | 123/321 |
| 5,357,926 | A | 10/1994 | Hu | |
| 5,526,784 | A | 6/1996 | Hakkenberg et al. | |
| 6,510,824 | B2 | 1/2003 | Vorih et al. | |
| 6,536,408 | B1 | 3/2003 | Warner | |
| 6,568,367 | B2 | 5/2003 | Rodier | |
| 6,622,694 | B2 | 9/2003 | Mickiewicz et al. | |
| 6,662,778 | B2 | 12/2003 | Leman | |
| 6,959,689 | B1 | 11/2005 | Megli et al. | |
| 7,059,282 | B2 | 6/2006 | Vorih et al. | |
| 7,201,140 | B2 | 4/2007 | Megli et al. | |
| 7,284,533 | B1 | 10/2007 | Huang et al. | |
| 7,299,623 | B2 | 11/2007 | Stanglmaier et al. | |
| 2007/0095312 | A1 | 5/2007 | Vanderpoel et al. | |
| 2007/0144472 | A1 | 6/2007 | Yang | |
| 2008/0210197 | A1 * | 9/2008 | Smith | 123/321 |

OTHER PUBLICATIONS

Jacobs Vehicle Systems, "Vehicle Noise Levels and Compression Release Engine Braking," dtd. 2000, (4 pages).

* cited by examiner

*Primary Examiner*—Mahmoud Gimie
(74) *Attorney, Agent, or Firm*—Finnegan, Henderson, Farabow, Garrett & Dunner

(57) ABSTRACT

The present disclosure is directed to a method of retarding an engine. The method includes selectively retarding the engine in a first mode configured to produce a first level of retarding at a first intensity of noise by selectively opening at least one exhaust valve between ninety degrees and zero degrees of an engine crank angle prior to top-dead-center of a compression stroke. The method also includes selectively retarding the engine in a second retarding mode configured to produce a second level of retarding at a second intensity of noise by maintaining an opening of at least one exhaust valve throughout the entire compression stroke.

20 Claims, 4 Drawing Sheets

ENGINE RETARDER HAVING MULTIPLE MODES

TECHNICAL FIELD

The present disclosure relates generally to a retarding system and, more particularly, to a retarding system having multiple modes.

BACKGROUND

Many vehicles, such as, for example, automobiles, on-highway trucks, or off-highway trucks often include a four stroke internal combustion engine that provides power for the vehicle. Four stroke internal combustion engines typically undergo an intake stroke, a compression stroke, an expansion stroke, and an exhaust stroke. To control the flow of gasses into and out of an engine's combustion chamber during normal operation, internal combustion engines typically include a group of valves. Under normal operating conditions, for example, when the engine is producing positive work, the intake and exhaust valves are typically closed during both the compression stroke and the expansion stroke. The intake valve is usually opened during the intake stroke to allow air to be drawn into the combustion chamber, and the exhaust valve is usually opened during the exhaust stroke to allow exhaust gas to be expelled from the combustion chamber. In addition to controlling the flow of gasses with respect to combustion, the flow of gasses may also be controlled to provide a retarding force against an engine piston. A retarder, also known as a compression release brake, is well known in the art for absorbing energy and reducing vehicle speed without the need to activate a service brake.

Retarders are routinely used on the open highway as well as in urban areas. Due to the noise generated by the retarder during compression release braking, many jurisdictions have instituted noise level restrictions, particularly in residential areas. Traditional retarders typically produce noise levels that exceed the maximum noise levels allowable by law. For this reason, vehicle operators are routinely prohibited from operating traditional retarders. As a result, the operator must rely on the service brake to slow the vehicle in cases where the retarder could otherwise be used to avoid wear and/or overheating of the service brake.

One way to reduce the noise generated by a retarding stroke is discussed in U.S. Pat. No. 5,357,926 (the '926 patent) issued to Haoran Hu. The '926 patent discloses a retarder which can be switched, whenever desired, between a normal mode of operation and a quiet mode of operation. In the normal mode, the retarder is set so that the exhaust valves are opened relatively close to top-dead-center. For example, in the normal mode the exhaust valve in an engine cylinder may be opened at an engine crank angle of approximately twenty degrees to thirty degrees prior to top-dead-center. By opening, or "blowing down" the valve near top-dead-center after the engine has significantly compressed the air, the normal mode provides relatively more braking power and also creates relatively more noise. In the quiet mode, the exhaust valve may be opened, or blown down, at an engine crank angle of sixty degrees to seventy degrees prior to top-dead-center. By opening the valve at this time, noise generated during the retarding stroke is reduced compared to the normal mode.

Although the '926 patent provides a retarder capable of operating in a quiet mode, certain disadvantages persist. For example, in quiet mode, the retarder of the '926 patent may still provide the high intensity noise associated with the blow down event.

The disclosed retarding system is directed to overcoming one or more of the problems set forth above.

SUMMARY

In one aspect, the present disclosure is directed to a method of retarding an engine. The method includes selectively retarding the engine in a first mode configured to produce a first level of retarding at a first intensity of noise by selectively opening at least one exhaust valve between ninety degrees and zero degrees of an engine crank angle prior to top-dead-center of a compression stroke. The method also includes selectively retarding the engine in a second retarding mode configured to produce a second level of retarding at a second intensity of noise by maintaining an opening of at least one exhaust valve throughout the entire compression stroke.

In another aspect, the present disclosure is directed to a method of operating a machine having an engine. The method includes selecting one of a first retarding mode and a second retarding mode based upon a signal received by a controller. The method also includes selectively controlling the engine in the first retarding mode by opening a first exhaust valve and a second exhaust valve between ninety degrees and zero degrees of an engine crank angle prior to top-dead-center of a compression stroke. The method further includes selectively controlling the engine in the second retarding mode by maintaining the first exhaust valve opening for substantially all of the compression stroke.

DETAILED DESCRIPTION

Figure 1:
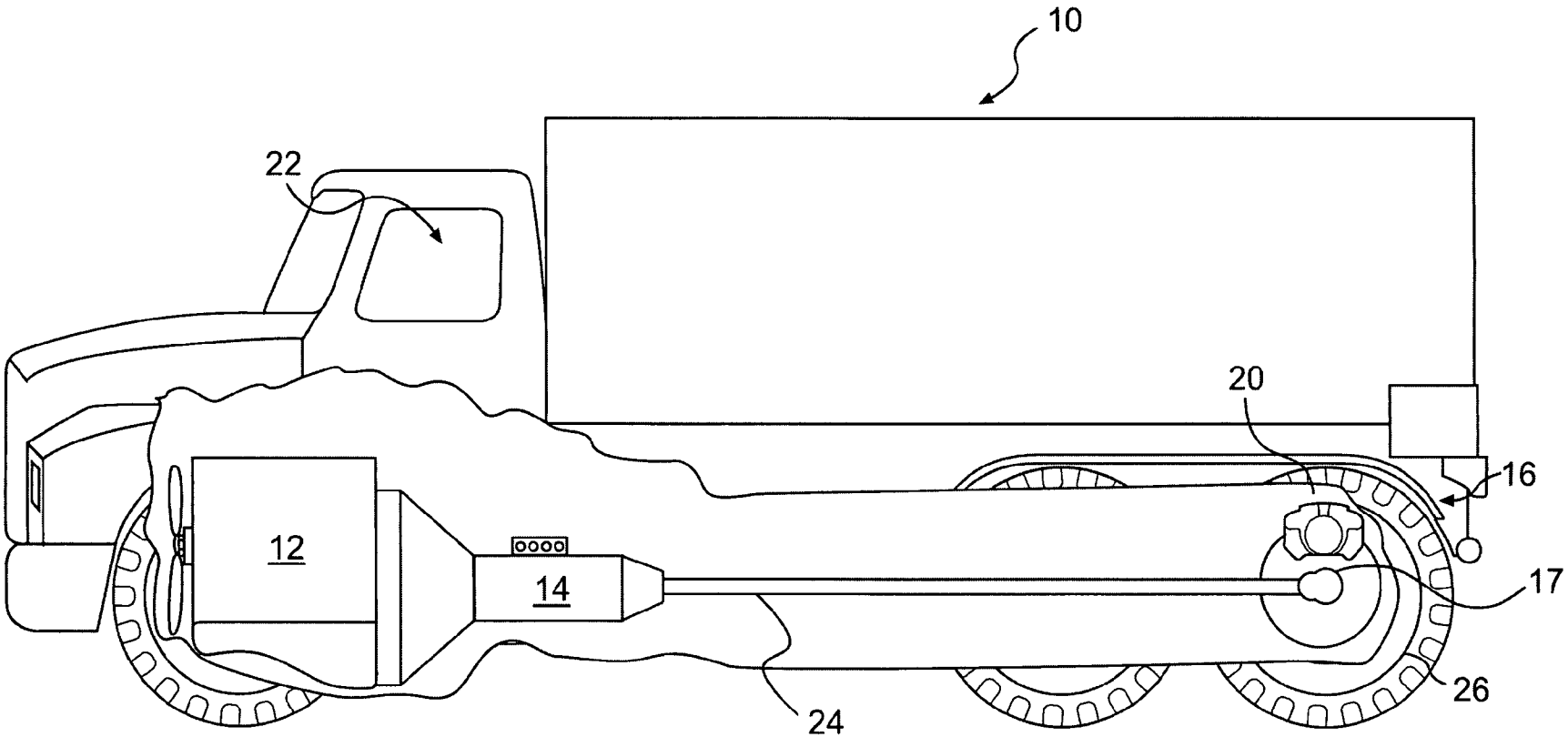
FIG. 1 is a diagrammatic illustration of an exemplary disclosed machine.

FIG. 1 illustrates an exemplary machine 10. Machine 10 may embody a mobile machine that performs some type of operation associated with an industry such as transportation, farming, mining, or construction. For example, machine 10 may be a heavy duty truck such as a delivery truck, a tractor-trailer, a dump truck, or any other on-highway truck. Machine 10 may alternatively embody an earth moving machine such as an off-highway haul truck, a wheel loader, a motor grader, or any other operation-performing machine. Machine 10 may include, among other things, a power source 12, a transmission 14 operably connected to one or more traction devices 16, a brake mechanism 20, and an operator station 22.

Power source 12 may be configured to produce a power output and may include an internal combustion engine. For example, power source 12 may include a diesel engine, a gasoline engine, a gaseous fuel-powered engine, or any other engine known in the art.

Transmission 14 may include numerous components that interact to transmit power from power source 12 to traction devices 16. In particular, transmission 14 may embody a multi-speed, bi-directional, mechanical transmission having a neutral gear ratio, a plurality of forward gear ratios, a reverse gear ratio, and one or more clutches (not shown). The clutches may be selectively actuated to engage predetermined combinations of gears (not shown) that produce a desired output gear ratio. The output of transmission 14 may be connected to rotatably drive traction devices 16 via a shaft 24, thereby propelling machine 10.

Traction devices 16 may include a set of wheels 26 located on each side of machine 10 (only one side shown). Alternatively, traction devices 16 may include tracks, belts, or other driven traction devices. Traction devices 16 may be driven by transmission 14 to rotate in accordance with an output of power source 12.

Brake mechanism 20 may be configured to retard the motion of machine 10 and may be operably associated with traction devices 16 of machine 10. In one embodiment, brake mechanism 20 may be a hydraulic pressure-actuated wheel brake such as, for example, a disk brake or a drum brake disposed between wheel 26 and a drive assembly 17. It is contemplated that brake mechanism 20 may alternatively embody another non-hydraulic type of brake such as an electric motor or any other similar mechanism known in the art.

Figure 2:
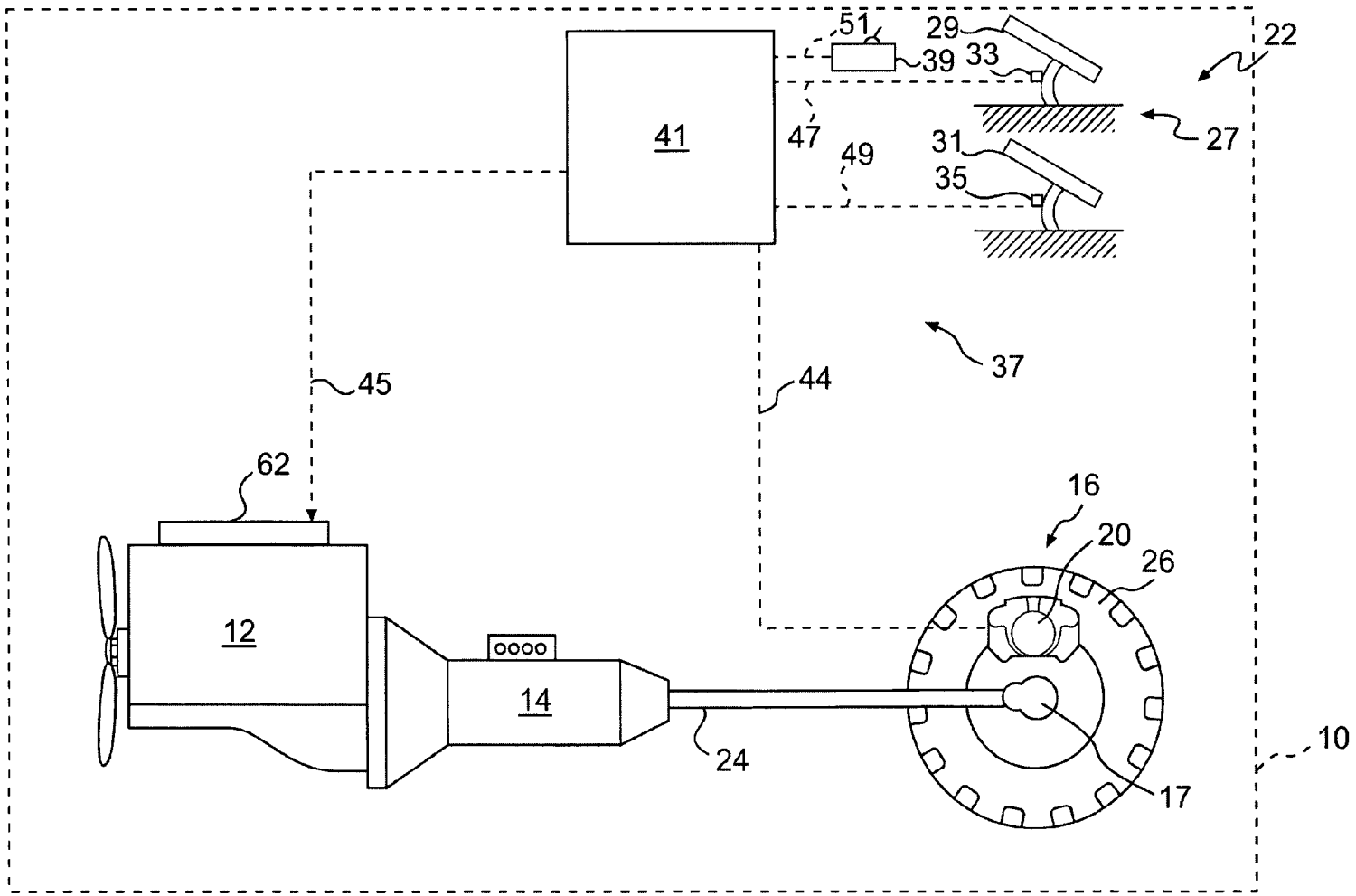
FIG. 2 is a diagrammatic illustration of an exemplary disclosed retarding system for the machine of FIG. 1.

Operator station 22 may be configured to receive input from a machine operator indicative of a desired propulsion of machine 10. Specifically, as illustrated in FIG. 2, operator station 22 may include one or more operator interface devices 27 such as a throttle pedal 29 and a brake pedal 31 located forward of an operator seat (not shown). Operator interface devices 27 may embody proportional-type controllers configured to increase or decrease the acceleration of machine 10 by producing an acceleration signal that may be indicative of a desired acceleration. It is contemplated that different operator interface devices may, alternatively or additionally, be included within operator station 22 such as, for example, single or multi-axis joysticks, wheels, knobs, push-pull devices, switches, and other operator interface devices known in the art.

Throttle pedal 29 may be manually actuated to increase the rotational speed of power source 12 and a resulting travel speed of machine 10. In particular, a degree of throttle pedal actuation may represent a desired acceleration and may correspondingly control an amount of fuel supplied to power source 12. It is contemplated that throttle pedal 29 may embody a mechanical device, an electrical device, a hydraulic device, or any other type of device known in the art.

A throttle sensor 33 may be provided for indicating a position of throttle pedal 29 and thus, the relative magnitude of the desired acceleration of machine 10. Throttle sensor 33 may embody, for example, a switch or a pressure sensor capable of producing an electric signal indicative of throttle pedal actuation. A switch may indicate a position or angle of throttle pedal 29, while a pressure sensor may indicate a pressure of a pilot fluid pressurized by the motion of throttle pedal 29.

Brake pedal 31 may be manually actuated to direct pressurized fluid to brake mechanism 20 to reduce the travel speed of machine 10. A degree of brake pedal actuation may correspondingly control a pressure and/or a flow rate of the fluid supplied to brake mechanism 20. It is contemplated that brake mechanism 20 may alternatively be pneumatically actuated, mechanically actuated, electrically actuated, or actuated in any other manner known in the art.

A brake sensor 35 may be provided for indicating when active retarding (e.g. deceleration) of machine travel is desired and the magnitude thereof. Brake sensor 35 may embody, for example, a switch or a pressure sensor capable of producing an electric signal indicating that negative acceleration is requested. A switch may indicate a position or angle of brake pedal 31, while a pressure sensor may indicate a pressure of a pilot fluid pressurized by brake pedal 31.

As also illustrated in FIG. 2, machine 10 may further include a retarding system 37 having components that cooperate with brake mechanism 20 to decelerate machine 10. In particular, retarding system 37 may include a retarding switch 39, a controller 41, and an actuation assembly 62. In the embodiment shown, retarding switch 39 may be used by the machine operator to command a retarding mode via controller 41.

Retarding switch 39 may embody any conventional device configured to generate an electric signal in response to commands made by the machine operator. For example, retarding switch 39 may embody a wheel actuator, a knob actuator, a push-pull device, a switch, or any other operator interface device manually selectable to command a particular retarding mode.

Controller 41 may embody a single microprocessor or multiple microprocessors configured to affect control and operation of retarding system 37. Various commercially available microprocessors can be configured to perform the functions of controller 41. It should be appreciated that controller 41 could readily embody a general machine microprocessor capable of controlling numerous other functions of machine 10. Controller 41 may be in communication with various components of machine 10. Specifically, controller 41 may be in communication with brake mechanism 20 via a communication line 44 to determine whether brake mechanism 20 is active or inactive. Additionally, controller 41 may be in communication with actuation assembly 62 via a communication line 45 to affect the mode of operation. Also, controller 41 may be in communication with throttle sensor 33 via a communication line 47, with brake sensor 35 via a communication line 49, and with retarding switch 39 via communication line 51. Various circuits may be associated with controller 41, including power supply circuitry, signal-conditioning circuitry, solenoid driver circuitry, communication circuitry, and other appropriate circuitry as is known in the art.

Controller 41 may be configured to affect the retarding of power source 12. Specifically, controller 41 may receive input from throttle sensor 33 associated with throttle pedal 29 and/or brake sensor 35 associated with brake pedal 31 and determine whether or not additional deceleration is desired. Additional deceleration may be indicated by the machine operator by reducing an actuation position of throttle pedal 29, increasing the actuation position of brake pedal 31, and/or continued actuation of brake pedal 31 for a predetermined period of time. Controller 41 may activate actuation assembly 62 in response to these received signals to affect an increase to the retarding of power source 12, thereby creating a retarding effect.

Figure 3:
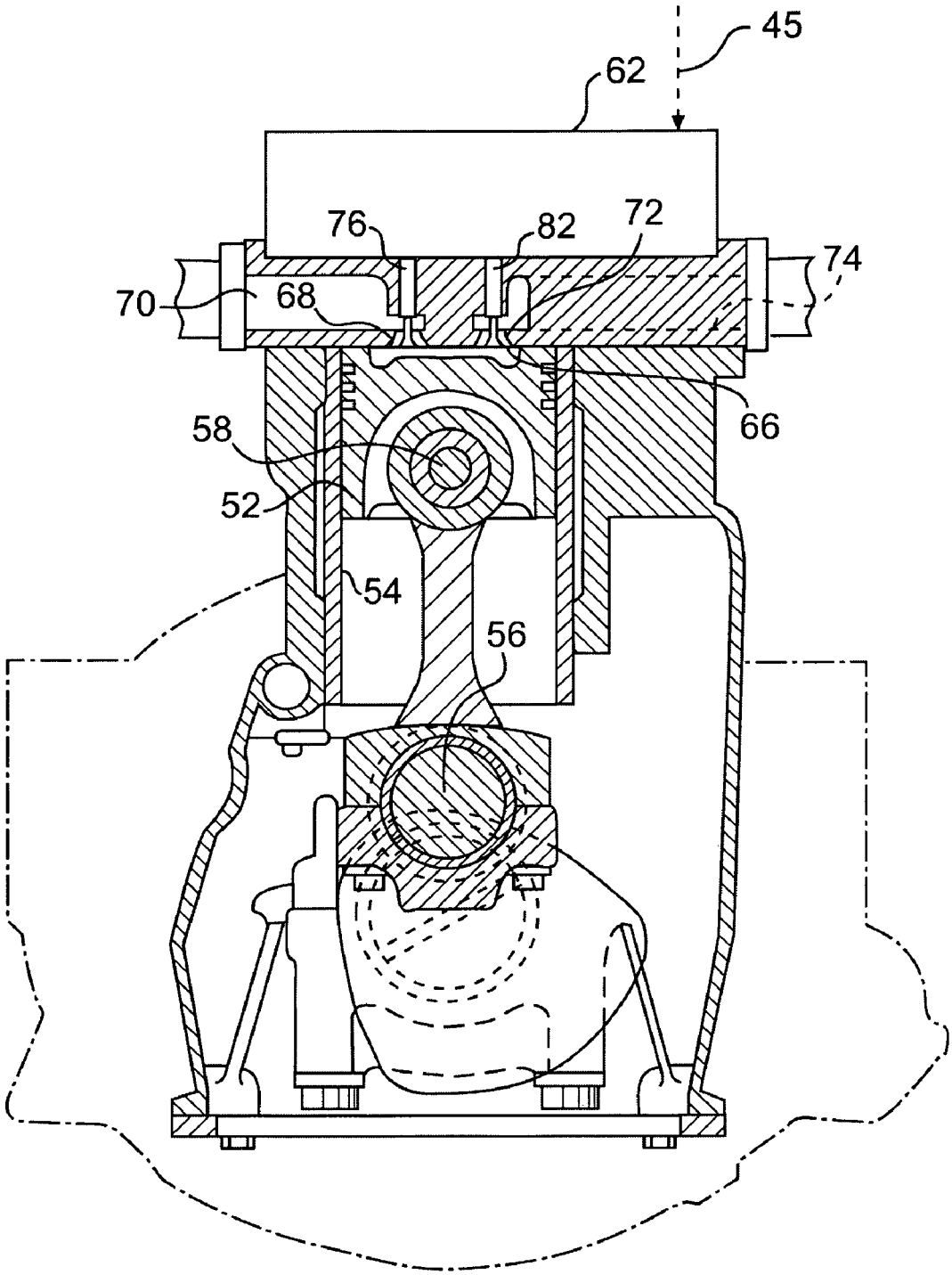
FIG. 3 is a diagrammatic illustration of an exemplary disclosed engine for use with the machine of FIG. 1.

As illustrated in FIG. 3, power source 12 may be a four stroke internal combustion engine, and may include numerous components and systems that cooperate to generate a power output. In particular, power source 12 may include a piston 52 slidably disposed within a cylinder 54 to form a combustion chamber 66. Additionally, power source 12 may also include at least one exhaust valve 76 (one shown), at least one intake valve 82, a crankshaft 56, and a connecting rod 58 operatively connecting piston 52 with crankshaft 56.

Piston 52 may reciprocate within cylinder 54 between a top-dead-center (TDC) position and a bottom-dead-center (BDC) position and/or, between a bottom-dead-center position and a top-dead-center position, during an intake stroke, a compression stroke, an expansion stroke (or combustion stroke), and an exhaust stroke. For example, during the intake stroke, crankshaft 56 may rotate to reciprocate piston 52 from the top-dead-center position to the bottom-dead-center position, and during the compression stroke from the bottom-dead-center position to the top-dead-center position. Each stroke of piston 52 correlates to about one hundred eighty degrees of crankshaft rotation, or crank angle. Thus, the intake stroke may begin at about zero degrees crank angle, the compression stroke at about one hundred and eighty degrees, the expansion stroke at about three hundred and sixty degrees, and the exhaust stroke at about five hundred and forty degrees.

Each exhaust valve 76 and intake valve 82 may be actuated by actuation assembly 62 to open or "lift" from a seated position thereby allowing a flow of fluid through an exhaust port 68 to an exhaust passageway 70 and through an intake port 72 from an intake passageway 74, respectively. As used herein, the term lift may refer to a distance that a valve may travel from a seated position or closed or substantially closed position to an open position. Exhaust valve or valves 76 and intake valve or valves 82 may be selectively lifted by valve actuation assembly 62 during positive power and retarding events of power source 12.

During a positive power event, that is, when fuel is being supplied to combustion chamber 66, intake valve 82 and exhaust valve or valves 76 may be opened by valve actuation assembly 62 in a conventional manner. For example, intake valve or valves 82 may be fully open during the intake stroke and may otherwise be closed. Further, exhaust valve or valves 76 may be fully opened during the exhaust stroke and may otherwise be closed.

During a retarding event, that is, when fuel is not being supplied to combustion chamber 66, intake valve or valves 82 may be opened by valve actuation assembly 62 in a conventional manner. However, exhaust valve or valves 76 may be selectively opened and closed by valve actuation assembly 62 to retard power source 12. For example, during a retarding event exhaust valve or valves 76 may be lifted and held in a lifted position for the duration of the four stroke cycle.

Valve actuation assembly 62 may include one or more hydraulic, mechanical, hydro-mechanical, and/or electromechanical actuation mechanisms. Further, components of valve actuation assembly 62 may be electronically controlled by controller 41 to vary valve actuation duration, timing, and lift of one or more exhaust valves 76 during compression retarding events.

In one exemplary embodiment, actuation assembly 62 may include a conventional valve train assembly with a cam located on a camshaft. The conventional valve train assembly may control the intake valve or valves 82 and exhaust valve or valves 76 in a conventional manner during positive power events and compression retarding events. In addition to the conventional valve train, one or more hydraulic actuators may be included with actuation assembly 62 to control one or more exhaust valves 76 during compression retarding events.

For example, actuation assembly 62 may include a first hydraulic actuator configured to act on the center of a valve bridge (not shown) of an exhaust valve system with two exhaust valves and, may open both exhaust valves simultaneously. A second hydraulic actuator may be included to act on only a single exhaust valve to selectively open only one of the two exhaust valves. That is, a second hydraulic actuator may be located above one exhaust valve and may be configured to tilt the valve bridge to open one exhaust valve while maintaining the other exhaust valve in a closed or seated position. The first and second hydraulic actuators may include appropriate valves and hydraulic sources and may be controlled via controller 41.

In an alternative embodiment, the conventional valve train assembly may only control intake valve or valves 82 and exhaust valve or valves 76 in the conventional manner during intake strokes and the exhaust strokes, respectively. During engine retarding events (compression release and compression bleed events), a dedicated exhaust or "braking" valve or valves may be actuated independently of the conventional drive train using for example, a dedicated hydraulic actuator system. The dedicated hydraulic actuator system may also include appropriate valves and hydraulic sources and may be controlled by controller 41.

As noted above, operation of retarding system 37 may be commanded by the machine operator by reducing the actuation position of throttle pedal 29, increasing the actuation position of brake pedal 31, and/or continued actuation of brake pedal 31 for the predetermined period of time. Upon sensing any of these actions, controller 41 may command a retarding event. As also noted above, retarding system 37 may be opened in one of two modes as determined by controller 41 according to the selected position of retarding switch 39. The retarding mode commanded by controller 41 may be a compression release mode or a compression bleed mode.

The compression release mode may provide more retarding power than the compression bleed mode. Additionally, since both retarding power and noise intensity are related to cylinder pressure, the compression release mode may also generate a greater noise intensity than the compression bleed mode. The machine operator may choose to operate in the compression release mode when maximum retarding power is preferred and in the compression bleed mode when minimum noise intensity is preferred.

It is contemplated that the power produced by the individual engine retarding events may be varied. Retarding system 37 may be controlled to actuate an engine braking event (compression release or compression bleed) in association with only one engine cylinder or a plurality of engine cylinders. For example, retarding system 37 may control engine braking events on two cylinders, four cylinders, or six cylinders to provide a low, a medium, and a high retarding power, respectively. Additionally, braking power may also be adjusted by modulating backpressure in the exhaust manifold. By increasing backpressure, retarding power may be increased and, conversely, by decreasing back pressure, retarding power may be decreased. For example, it may be possible to vary backpressure through the control of a variable geometry turbocharger (not shown). Varying the power of the individual engine retarding events may be achieved by an operator switch, remotely, or based on sensed operating conditions of power source 12.

Figure 4:
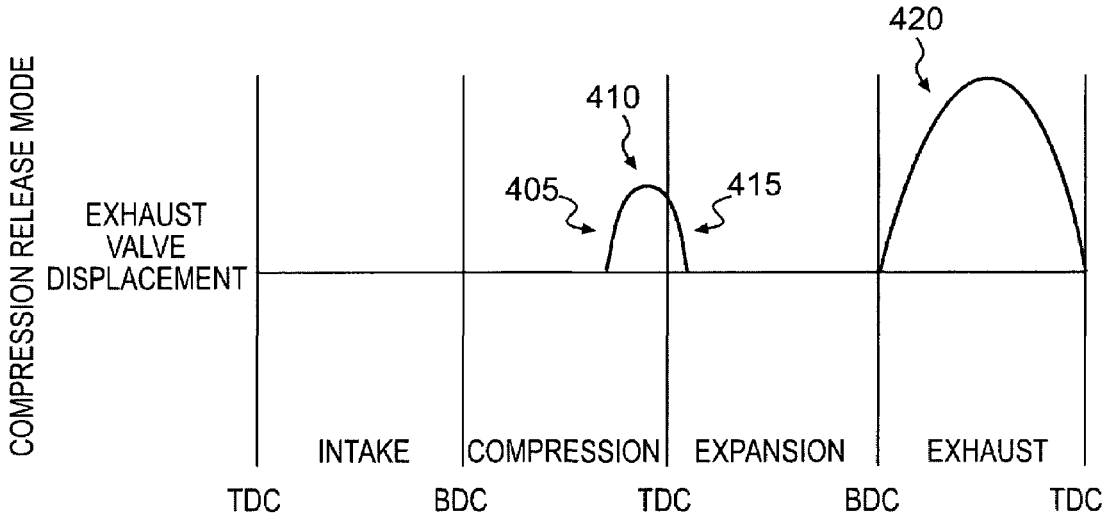
FIG. 4 is a graph illustrating exhaust valve actuation events of a compression release mode of the retarding system.

In the compression release mode, actuation assembly 62 may be commanded by controller 41 to open one or more exhaust valves 76 during the compression stroke near but before piston 52 reaches the top-dead-center position. In the compression release mode, one or more exhaust valves may be lifted to a distance of about five millimeters. It is contemplated that each exhaust valve 76 may be opened in the compression release mode as far away as ninety degrees prior to top-dead-center. Opening exhaust valve or valves 76 during the compression stroke may cause a "blow-down" event. That is, the fluid compressed within cylinder 54 may rapidly expand into the exhaust manifold causing a high intensity noise that may be described as a "pop." Noise may be caused by a pressure wave generated when the high pressure fluid from combustion chamber 66 expands rapidly into exhaust passageway 70. The intensity of the noise may be proportional to the pressure gradient between combustion chamber 66 and exhaust passageway 70. Thus, the intensity of noise may be proportional to the crank angle at the time of the blow-down event since at crank angles closer to top-dead-center more work may have been done to compress the fluid within combustion chamber 66. An exemplary compression release event is shown in FIG. 4 illustrating the movements of exhaust valve or valves 76.

It is contemplated, that in the compression release mode, retarding power may be varied by varying the timing of the blow down event. For example, the blow down event may be timed to occur at an engine crank angle of twenty degrees prior to top-dead-center. At this engine crank angle, more work may have been done to compress the fluid within combustion chamber 66 and, thus, more retarding power builds up. In another example, the blow down event may be timed to occur at an engine crank angle of eighty degrees prior to top-dead-center. At this engine crank angle less work may have been done to compress the fluid within combustion chamber 66 and, thus, less retarding power builds up. As stated above, the blow down event may occur as far away as ninety degrees prior to top-dead-center and retarding power may increase with crank angle, with a maximum retarding power occurring near to top-dead-center.

Figure 5:
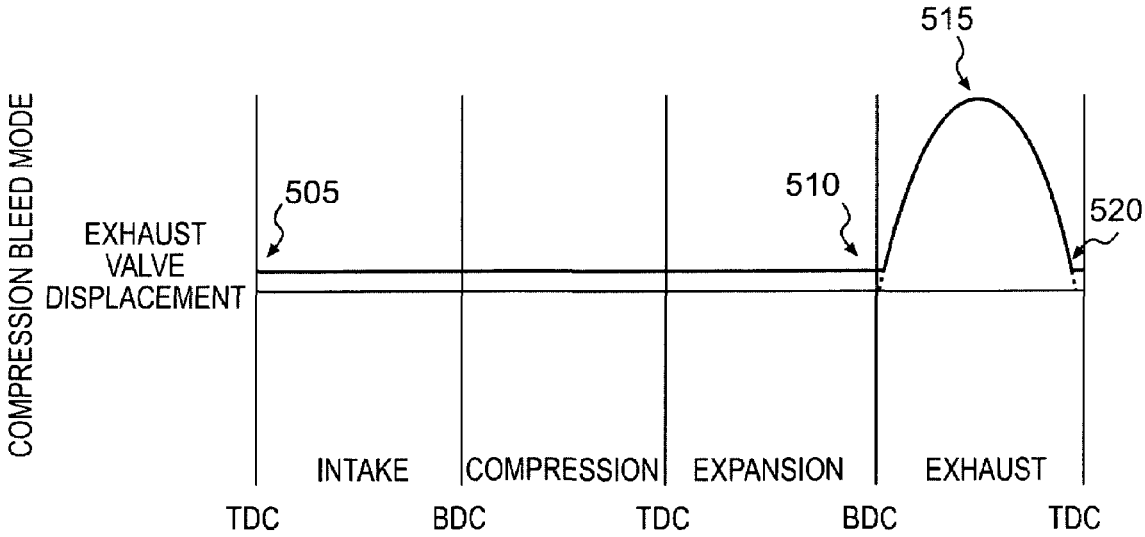
FIG. 5 is a graph illustrating exhaust valve actuation events of a compression bleed mode of the retarding system.

In the compression bleed mode, controller 41 may command actuation assembly 62 to maintain exhaust valve 76 in the open position for all or substantially all of the compression stroke. For example, in the compression bleed mode, a single exhaust valve 76 may open up to twenty degrees of crank angle after bottom-dead center of the compression stroke and, remain open for the rest of the compression stroke. Additionally or alternatively, in one embodiment of the compression bleed mode, exhaust valve 76 may be initially fully opened by the cam of the valve train assembly during the exhaust stroke and then one exhaust valve 76 may be caught and held partially open for the duration of the retarding event in the compression bleed mode. This single exhaust valve may be held in a lifted position, at about two millimeters, during succeeding strokes, including the compression stroke. The partial opening of exhaust valve 76 in compression bleed mode may be less than the opening of exhaust valve 76 in the compression release mode. It is contemplated that actuation assembly 62 could hold exhaust valve 76 partially open at a substantially fixed lift, or the lift value may be varied during the compression stroke in the compression bleed mode. An exemplary compression bleed event is shown in FIG. 5 illustrating the movements of exhaust valve or valves 76.

As noted above, it is contemplated that the disclosed retarding system may open two exhaust valves in the compression release mode during the compression stroke. Both exhaust valves may be opened simultaneously by actuation assembly 62. It is further contemplated that in the compression bleed mode only one of exhaust valves 76 may be open during the compression stroke. Also as noted above, during the exhaust stroke, both exhaust valves may be lifted by the valve train to their fully open positions regardless of retarding mode. Thus, if the system is in the compression bleed mode, at the end of an exhaust stroke one of exhaust valves 76 will be allowed to travel to its closed position while the other exhaust valve may be restrained from closing by actuation assembly 62.

In any case, retarding power and noise intensity may be proportional to the energy stored within the fluid during the compression stroke. Since the compression bleed mode does not have a blow-down event, the noise intensity associated with this mode may be less than that of the compression release mode. In addition to creating less noise, the compression bleed mode may also provide a level of retarding power approaching the retarding power provided by the compression release mode. For example, the compression bleed mode may provide only approximately twenty percent less retarding power than the level of retarding provided by the compression release mode. This level of retarding power provided by the compression bleed mode relates to the fact that the retarding power is being created while the piston is moving at the highest rate of speed, that is, during the middle of the compression stroke.

INDUSTRIAL APPLICABILITY

The disclosed retarding system may be applicable in any machine to control noise intensity and, in particular, in on-highway trucks, particularly on-highway trucks for use in urban areas with noise restrictions. One skilled in the art will recognize however, that the disclosed retarding system could be utilized in relation to other machines that may or may not be associated with on-highway trucks.

During the operation of machine 10, the machine operator may adjust retarding switch 39 to select a specific retarding mode from actuation assembly 62. The machine operator may command the specific retarding mode based upon local ordinances restricting noise, on a desired level of vehicle retarding, or on any other criteria. After selecting the retarding mode, the machine operator may command operation of retarding system 37 by reducing the actuation position of throttle pedal 29, increasing the actuation position of brake pedal 31, and/or continued actuation of brake pedal 31 for the predetermined period of time. Upon sensing any of these actions, controller 41 may determine the retarding mode based on the signal received from retarding switch 39.

In one example, retarding switch 39 may be set to operate retarding system 37 in compression release mode. After controller 41 has commanded actuation assembly 62 into compression release mode, valve actuation assembly 62 may open intake valve 82 during the next intake stroke. As piston 52 moves from top-dead-center to bottom-dead-center it may draw fluid from the intake manifold through intake passageway 74, and into combustion chamber 66. As the intake stroke ends, piston 52 may reach bottom-dead-center, the intake valves 82 may close, and the compression stroke may begin. Piston 52, using energy provided by the momentum of machine 10 compresses fluid within combustion chamber 66 as it moves from bottom-dead-center to top-dead-center.

Referring now to FIG. 4, when piston 52 approaches top-dead-center, controller 41 may command valve actuation assembly 62 to open (405) exhaust valve or valves 76 and blow-down the compressed fluid within combustion chamber 66 into exhaust passageway 70. Exhaust valve or valves 76 may remain lifted (410) until top-dead-center or just after top-dead-center of the compression stroke (415). After top-dead-center of the compression stroke, exhaust valve or valves 76 may seat to the closed position until the valve train of valve actuation assembly 62 opens exhaust valve or valves 76 for the exhaust stroke (420). Since the compressed fluid may be vented into exhaust passageway 70 during the blow down event, the energy stored in the fluid may not be transferred back to machine 10 during the expansion stroke. Thus, energy may be extracted from the momentum of machine 10 thereby reducing its travel speed.

In another example, retarding switch 39 may be set by the machine operator to operate retarding system 37 in the compression bleed mode. Upon beginning compression bleed mode, controller 41 may command valve actuation assembly 62 to lift exhaust valve 76 to a partially open position and to hold exhaust valves or valves 76 in the lifted position for an entire four stroke cycle. During the compression stroke, fluid may "bleed" from combustion chamber 66 to exhaust passageway 70. However, since each exhaust valve 76 is only lifted a small distance from the seated position, fluid flow from combustion chamber 66 may be restricted, causing piston 52, to compress fluid as it escapes. As in the compression release mode, energy may be lost as the compressed fluid moves from combustion chamber 66 to exhaust passageway 70.

Actuation assembly 62 may hold exhaust valve 76 open for the duration of compression and expansion strokes. Upon reaching bottom-dead-center to begin the exhaust stroke, actuation assembly 62 may hand off (510) the partially open exhaust valve 76 to the conventional valve train assembly. That is, the valve train may open each exhaust valve 76 to its full open position (515). Upon reaching its fully open position, exhaust valves 76 may close to its seated position or exhaust valve 76 may be retained partially opened (520) by actuation assembly 62 as described above. If exhaust valve 76 is retained open by actuation assembly 62, the valve may remain in the lifted position for at least one more four stroke cycle.

It will be apparent to those skilled in the art that various modifications and variations can be made to the disclosed retarding system without departing from the scope of the disclosure. Other embodiments of the disclosed embodiments will be apparent to those skilled in the art from consideration of the specification and practice disclosed herein. For example, another embodiment of the present disclosure may include two exhaust valves that may be opened during the compression bleeding event. Further, retarding switch 39 may be omitted and the machine may receive signals from external sources that identify the retarding mode. Such other sources may include communications from other machines, a global positioning type system, or other external machine manager. It is intended that the specification and examples be considered as exemplary only, with the true scope being indicated by the following claims and their equivalents.

What is claimed is:

1. A method of retarding an engine, comprising:

selectively retarding the engine in a first mode configured to produce a first level of retarding at a first intensity of noise by selectively opening at least one exhaust valve between ninety degrees and zero degrees of an engine crank angle prior to top-dead-center of a compression stroke;

determining a need for engine retarding at a lower noise intensity than said first intensity of noise; and selectively retarding the engine in a second mode based on said determination, said second mode being configured to produce a second level of retarding at a second intensity of noise by maintaining at least one exhaust valve in a open position from at least about 120 degrees of crank angle from top-dead-center to top-dead-center of the compression stroke.

2. The method of claim 1, wherein in the second mode, the at least one exhaust valve is maintained in an open position throughout the entire compression stroke.

3. The method of claim 1, further including a retarding switch selectable between at least a first position and a second position corresponding to the first mode and the second mode, respectively, the retarding switch further configured to generate a signal indicative of the selected position.

4. The method of claim 1, wherein in the second mode, the at least one exhaust valve is in a partially open position in the compression stroke and in a fully open position in an exhaust stroke of the engine.

5. The method of claim 1, wherein the selectively opening the at least one exhaust valve during the compression stroke in the first mode includes opening two exhaust valves.

6. The method of claim 1, wherein the maintaining of the at least one exhaust valve in a partially open position throughout the entire compression stroke in the second mode includes maintaining only one exhaust valve in the open position.

7. The method of claim 1, wherein the at least one exhaust valve maintained in the open position during the second mode includes a dedicated braking valve.

8. The method of claim 1, wherein selectively retarding the engine in the second mode further includes maintaining the at least one exhaust valve in the open position throughout an intake stroke and an expansion stroke.

9. The method of claim 1, wherein the selectively retarding the engine in the first mode includes opening a first exhaust valve to a first lift value and the selectively retarding the engine in the second mode includes maintaining a second exhaust valve in the open position at a second lift value, the first lift value being greater than the second lift value.

10. A method of operating a machine having an engine, comprising:

selecting one of a first retarding mode and a second retarding mode based upon a signal received by a controller, said signal being indicative of an acceptable noise intensity;

selectively controlling the engine in the first retarding mode by opening a first exhaust valve and a second exhaust valve between ninety degrees and zero degrees of an engine crank angle prior to top-dead-center of a compression stroke; and selectively controlling the engine in the second retarding mode by maintaining the first exhaust valve in an at least partially open position from at least about 120 degrees of crank angle from top-dead center to top-dead-center of the compression stroke.

11. The method of claim 10, wherein the second retarding mode includes maintaining the first exhaust valve in the partially open position for the entire compression stroke.

12. The method of claim 10, wherein the second retarding mode further includes maintaining the first exhaust valve in the at least partially open position for an intake stroke and an expansion stroke.

13. The method of claim 10, wherein the first exhaust valve and the second exhaust valve are fully opened during an exhaust stroke, in the second retarding mode the first exhaust valve is restrained from closing near an end of the exhaust stroke.

14. The method of claim 10, wherein the first exhaust valve is opened to a greater lift value in the compression stroke in the first retarding mode than a lift value of the first exhaust valve in the compression stroke in the second retarding mode.

15. The method of claim 10, wherein the first exhaust valve and the second exhaust valve are hydraulically actuated when opened during the compression stroke.

16. The method of claim 10, wherein the signal is indicative of a retarding switch, the retarding switch selectable by a machine operator to operate a retarder in one of the first retarding mode and the second retarding mode.

17. The method of claim 10, wherein a first noise level is generated by the first retarding mode and a second noise level is generated by the second retarding mode, the first noise level having and intensity greater than the second noise level.

18. The method of claim 10, wherein the first retarding mode provides a first level of retarding greater than a second level of retarding provided by the second retarding mode.

19. The method of claim 10, wherein the selectively controlling the engine in the second retarding mode further includes maintaining the first exhaust valve in the at least partially open position for at least one four stroke cycle.

20. A machine, comprising an engine with an engine crank and an exhaust valve configured to produce a power output;

a traction system coupled with the engine and configured to propel the machine;

a dual mode retarding system operable to command one of a first retarding mode and a second retarding mode, the first retarding mode including opening at least one exhaust valve between ninety degrees and zero degrees of an engine crank angle prior to top-dead-center of a compression stroke, the second retarding mode including maintaining at least one exhaust valve in an open position from at least about 120 degrees from top-dead-center to top-dead-center of the compression stroke; and a controller in communication with the dual mode retarding system and configured to:

determine a retarding mode based on at least one signal, said at least one signal being indicative of a desirable noise intensity;

receive at least one signal from at least one sensor; and affect operation of the determined retarding mode.

* * * * *